United States Patent [19]

Martin

[11] Patent Number: 4,614,003

[45] Date of Patent: Sep. 30, 1986

[54] PILE HEIGHT SETTING DISPLAY FOR VACUUM CLEANER

[75] Inventor: William J. Martin, Watervliet, Mich.

[73] Assignee: Whirlpool Corporation, Benton Harbor, Mich.

[21] Appl. No.: 718,787

[22] Filed: Apr. 1, 1985

[51] Int. Cl.[4] ..... A47L 5/34

[52] U.S. Cl. ..... 15/339; 15/354

[58] Field of Search ..... 15/339, 354, 355, 356

[56] References Cited

U.S. PATENT DOCUMENTS

| | | | |
|---|---|---|---|
| 2,107,016 | 2/1938 | Snyder | 15/354 X |
| 2,823,412 | 2/1958 | Kirby | 15/354 |
| 3,381,652 | 5/1968 | Schaefer et al. | 15/339 X |
| 3,587,515 | 6/1971 | Anderson et al. | 15/339 X |
| 3,683,448 | 8/1972 | Lagerstrom et al. | 15/354 |
| 4,437,205 | 3/1984 | Koland | 15/354 |
| 4,467,495 | 8/1984 | Fish et al. | 15/354 |

FOREIGN PATENT DOCUMENTS

| | | | |
|---|---|---|---|
| 2052298 | 1/1981 | United Kingdom | 15/339 |

*Primary Examiner*—Chris K. Moore

*Attorney, Agent, or Firm*—Wood, Dalton, Phillips Mason & Rowe

[57] ABSTRACT

A vacuum cleaner nozzle having a housing including a top wall. A device for indicating an adjusted characteristic of the vacuum cleaner nozzle is mounted within the housing substantially below the top wall and, in the illustrated embodiment, on a bottom wall of the housing. Structure is provided for causing a selected one of the indicia of the indicator discernible to a user of the vacuum cleaner standing above the nozzle, notwithstanding the recessing of the indicator substantially deeply within the nozzle. In the illustrated embodiment, the structure for causing the indicium to be discernible includes a focus tube formed integrally with the top wall extending to closely adjacent the indicator and having a distal portion configured complementarily to the indicator. In the illustrated embodiment, the device for causing the indicator to be discernible to the user is defined by a synthetic resin magnifier secured to the focus tube so as to be substantially flush with the top wall of the nozzle.

19 Claims, 7 Drawing Figures

FIG. 2
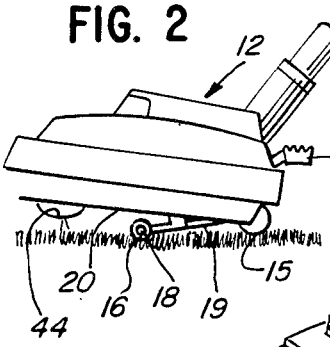
FIG. 1
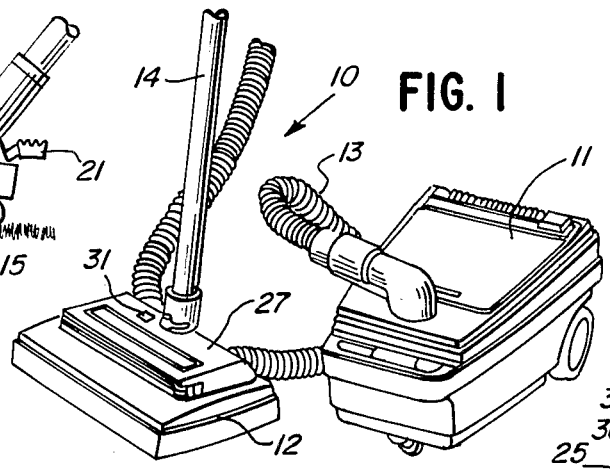
FIG. 4
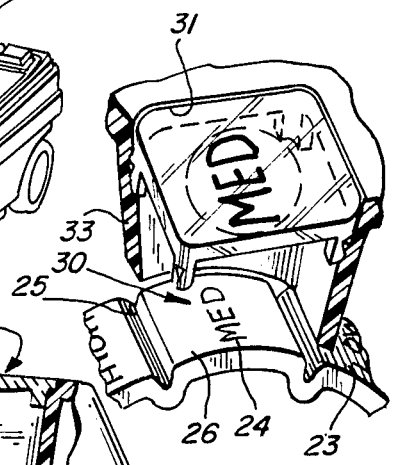
FIG. 3
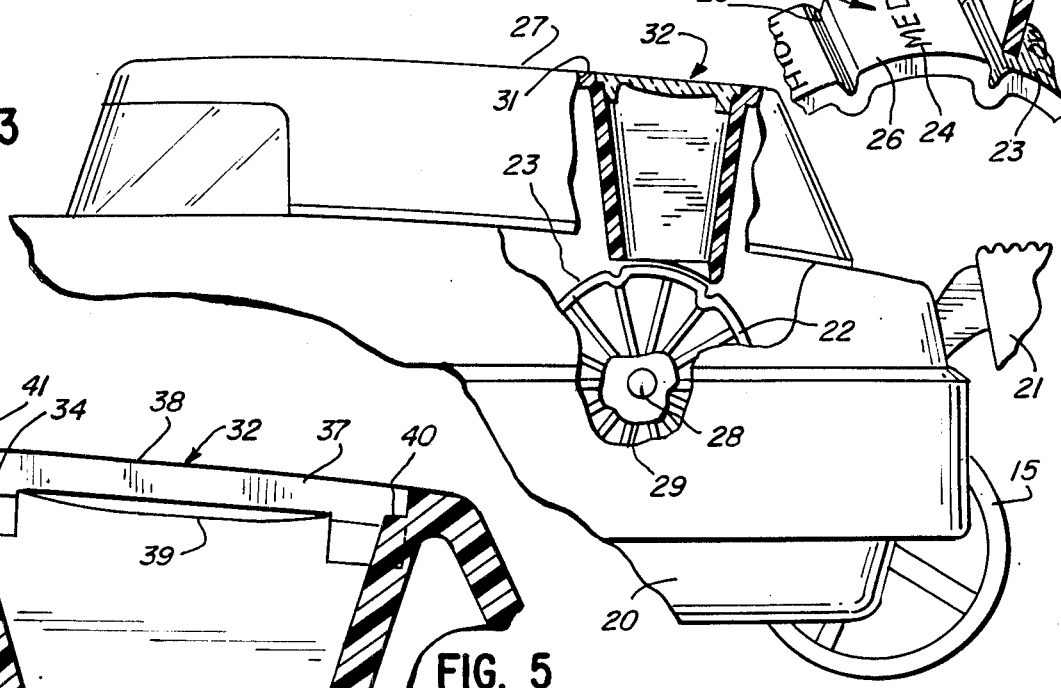
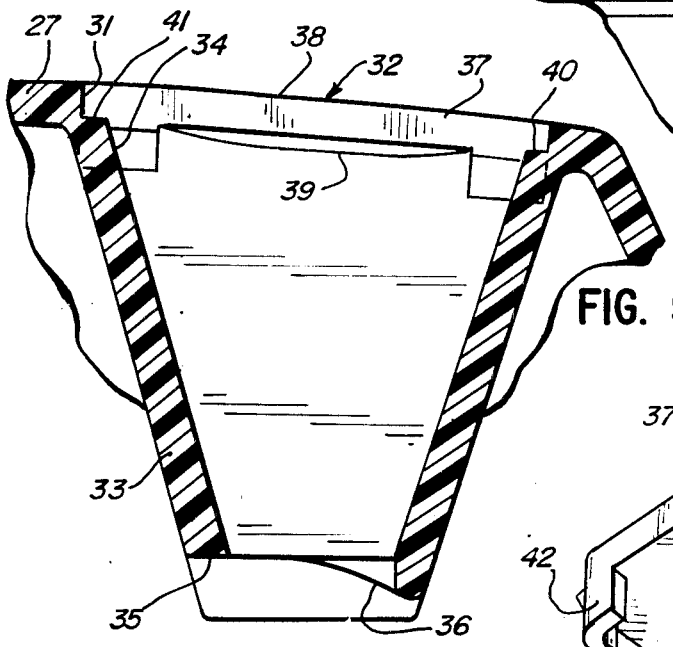
FIG. 5
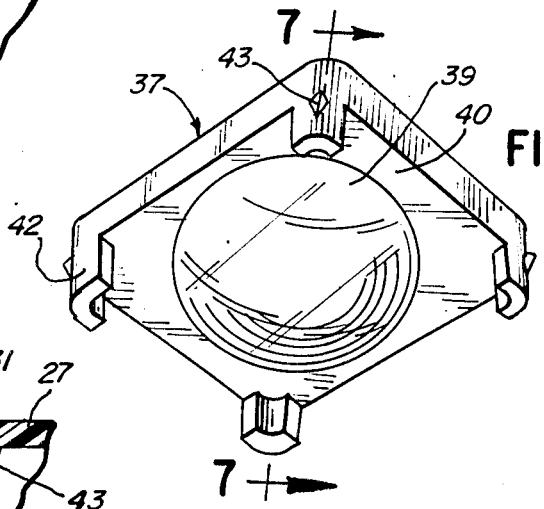
FIG. 6
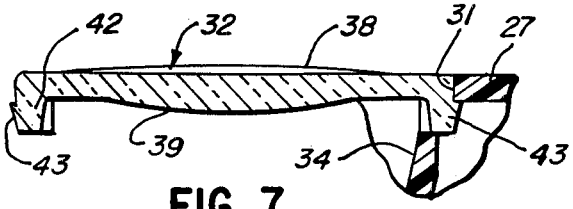
FIG. 7

PILE HEIGHT SETTING DISPLAY FOR VACUUM CLEANER

TECHNICAL FIELD

This invention relates to vacuum cleaners and in particular to means for indicating an adjusted characteristic of a vacuum cleaner nozzle.

BACKGROUND ART

In one improved form of vacuum cleaner nozzle disclosed in U.S. Pat. No. 4,437,205 of David G. Koland, which patent is owned by the assignee hereof, a lift device is provided for adjustably raising the front portion of the nozzle, such as for use with different pile height carpets. The lift device includes a U-shaped front wheel assembly, including a support having a rear bight pivotally mounted to the nozzle housing and a pair of forwardly extending legs with wheels rotatably carried on the distal end portions of the legs. The adjuster includes a lifter slidably embracing a leg of the support forwardly of the bight and mounted to a rear portion of the housing adjacent the bight. A cam follower is movable with the lifter and a cam is movably carried by the housing for camming engagement with the cam follower. A foot pedal disposed to be engaged by the user's foot is provided for selectively moving the cam against the cam follower for correspondingly swinging the support about the axis of the bight to selectively raise and lower the front wheels on the U-shaped support to thereby adjust the angular disposition of the nozzle housing relative to the subjacent floor. The present invention utilizes a front wheel adjuster of this type and the Koland U.S. Pat. No. 4,437,205 is incorporated by reference herein as illustrating such structure.

Another vacuum cleaner nozzle adjuster of this type is disclosed in U.S. Pat. No. 4,467,495 of Warren H. Fish et al., which patent is also owned by the assignee hereof. The fish et al. patent structure differs from that of the Koland patent in providing a thumbwheel which is manually accessible through the top wall of the nozzle.

While each of the nozzle lift devices of the above described vacuum cleaner nozzles provides facilitated adjustment of the nozzle disposition, it has been found, in some instances, the user encounters some trouble in reading the setting of the device indicated by suitable indicia carried on the ratchet wheel or thumbwheel.

DISCLOSURE OF INVENTION

The present invention provides an improved vacuum cleaner nozzle structure wherein the setting of the lift device is readily discernible to the user.

In the illustrated embodiment, the indicating device is recessed within the housing of the nozzle substantially below the top wall thereof.

The invention comprehends providing means in association with the indicating device for rendering indicia on the device discernible to the user notwithstanding the recessed condition.

The means for rendering the indicia discernible in the present invention includes a focus tube which depends from the top wall of the nozzle to closely adjacent the indicator means.

The lower distal end of the focus tube is configured complementarily to the indicator means to permit selective adjustment of the indicator means without interference from the focus tube.

The focus tube may be provided with a magnifier in the upper portion thereof, and in the illustrated embodiment, the magnifier comprises a synthetic resin lens mounted in the upper end of the focus tube so as to be substantially flush with the top wall of the nozzle.

The lens may be secured to the focus tube by integral fastening means, such as barbs provided in depending corner portions thereof.

In the illustrated embodiment, the focus tube comprises a frustopyramidal wall means and the magnifying lens comprises a lens having a correspondingly rectangular periphery adapted to be complementary to the upper end of the focus tube.

The indicia indicating means of the present invention is extremely simple and economical of construction while yet providing improved facility in the reading of the setting of the pile height adjusting means of the nozzle, which may be readily discernible by the user notwithstanding the user standing above the nozzle with the indicator means being recessed substantially within the housing below the top wall thereof.

BRIEF DESCRIPTION OF THE DRAWING

Other features and advantages of the invention will be apparent from the following description taken in connection with the accompanying drawing wherein:

FIG. 1 is a fragmentary perspective view of a vacuum cleaner having a nozzle lift indicating means embodying the invention;

FIG. 2 is a fragmentary side elevation of the nozzle;

FIG. 3 is a fragmentary enlarged side elevation of the nozzle with portions broken away to facilitate illustration of the indicating means thereof;

FIG. 4 is a fragmentary perspective view of the indicating means;

FIG. 5 is an enlarged vertical section of the indicating means;

FIG. 6 is a bottom perspective view of the magnifying lens of the indicating means; and FIG. 7 is a transverse section taken substantially along the line 7—7 of FIG. 6 and further illustrating the mounting of the edge of the magnifying lens to the upper end of the focus tube.

BEST MODE FOR CARRYING OUT THE INVENTION

In the exemplary embodiment of the invention as disclosed in the drawing, a vacuum cleaner generally designated 10 is shown to comprise a canister-type vacuum cleaner having a canister 11 and a nozzle 12 connected to the canister by a suction hose 13. The suction hose is connected to the nozzle through a wand 14 which serves as a handle for moving the nozzle over the subjacent floor surface to be cleaned, which may comprise carpeting and the like. Nozzle 12 includes a pair of rear wheels 15 and a pair of front wheels 16. The rear wheels are journaled about fixed rotation axes on the nozzle body, or housing, 17.

As discussed above, the front wheels are utilized as a part of the nozzle lift device and are carried on outturned ends 18 of a U-shaped support 19 swingably mounted to the base 20. A foot pedal 21 rotates a ratchet wheel 22 of the nozzle lift device incrementally as a result of seriatim depression of the foot pedal by the user's foot to adjust the upwardly inclined disposition of the nozzle housing in any one of a plurality of different angular dispositions. As discussed above, U.S. Pat. No. 4,437,205 of David G. Koland is incorporated by reference herein and discloses in detail the functioning of the lift device. For purposes of the present invention, however, it need only be understood that the lift device of the present invention includes a ratchet wheel portion which defines a peripheral surface 23 provided at circumferentially spaced intervals with indicia 24. As shown in FIG. 4, surface 23 may be provided with spaced transverse notches 25 defining successive fields 26 of the indicia.

The present invention, as indicated above, is concerned with the problem of making readily discernible to the user the different indicia 24 indicating different settings of the lifter mechanism. As shown in FIG. 3, the indicator wheel 22 is spaced substantially below the top wall 27 of the nozzle. In the illustrated embodiment, the wheel 22 includes an axle 28 which is rotatable in a frame 29 carried on the base 20 of the nozzle so as to dispose selectively different indicia at a viewing position 30 subjacent an opening 31 in the top wall 27.

The invention comprehends the provision of means for causing each indicium at the viewing position 30 to be readily discernible to the user of the vacuum cleaner notwithstanding the substantial recessing of the indicium within the housing and notwithstanding the user's viewing of the indicium from a standing position over the nozzle in the normal operation of the vacuum cleaner. Thus, the invention broadly comprehends the provision of means for viewing the indication of the adjusted characteristic of the vacuum cleaner nozzle through the opening 31 and, as shown in FIG. 5, the viewing enhancing means generally designated 32 includes a focus tube 33 comprising an integral depending portion of the top wall 27 defining a top portion 34 and a lower distal end 35.

The lower distal end, as seen in FIG. 5, defines an arcuate surface 36 which is complementary to the cylindrical surface 23 of the wheel 22, permitting the wheel to be rotated on the axle 28 in close proximity to the lower end 35 of the focus tube, so that the focus tube directs the view of the user to the single field 26 bearing the indicium 24 corresponding to the adjusted height of the front of the nozzle, such as the medium height arrangement of FIG. 2.

In the illustrated embodiment, the focus tube comprises a frustopyramidal tube having downwardly converging sidewalls. Opening 31 of the top wall is correspondingly rectangular.

A magnifying lens 37 is secured in the top portion 34 of the focus tube, as seen in FIG. 5. Lens 37 is preferably formed of a synthetic resin and defines a convex outer surface 38, a convex inner surface 39, and a planar peripheral inner surface 40 adapted to seat on a peripheral shoulder 41 of the focus tube at opening 31.

As best seen in FIG. 6, lens 37 includes a plurality of depending lugs 42 at the corners thereof adapted to fit into the complementary corners of the opening 31. The lugs are provided with outwardly projecting shoulder portions 43 adapted to interlock with the focus tube, as seen in FIG. 7, to lock the lens in the outer end portion 34 of the focus tube substantially flush with the top wall 27.

As seen in FIG. 4, convex-convex lens 37 magnifies the image of the indicium 24 at the viewing position 30 so as to render the indicium discernible to the user of the vacuum cleaner, and focus tube 33 comprises means for restricting the user's view of the indicia to substantially only the indicium disclosed at the viewing position, improving discernment, notwithstanding the user standing above the nozzle, with the nozzle resting on the floor. Thus, the invention provides an improved facilitated use of the adjusting means by making readily determinable by the user the setting for which he has adjusted the nozzle, thereby assuring proper disposition of the vacuum cleaner for the different carpet heights. By assuring the proper setting of the nozzle, improved long life of the carpet is obtained as optimum cleaning of the carpet as by the brush 44 provided on the nozzle is obtained.

By restricting the user's view to the single field 26, a positive identification of the adjustment of the nozzle is provided to the user.

In the illustrated embodiment, the indicia comprise words, or portions of words, identifying the different adjusted heights. As will be obvious to those skilled in the art, any suitable indicia may be utilized, such as the numeral indicia of the prior art patents discussed above.

In the illustrated embodiment, the lens magnifying means is arranged to magnify the indicium approximately 50 per cent i.e. to a magnification of about 1.5×. It is found that by utilizing such a magnification, the indicium is readily discernible by the user under the circumstances discussed above.

The elimination of the need for the indicating wheel to project through the top wall of the housing, as required in the prior art patents, permits a simplified, low cost manufacture, while providing improved coaction between the elements of the adjusting means.

The invention further provides flexibility in the location of the carpet pile height setting display relative to the viewing level, permitting preselection of the nozzle cover surface location relative to the pile height setting display.

The foregoing disclosure of specific embodiments is illustrative of the broad inventive concepts comprehended by the invention.

I claim:

1. In a vacuum cleaner nozzle having a housing including a top wall, adjusting means for selectively adjusting the angular disposition of the nozzle housing relative to a subjacent surface to be cleaned including a ratchet wheel having indicium thereon, and user-operated means for operating said adjusting means with concurrent repositioning of the ratchet wheel, the improvement comprising:

means for rotatably mounting said ratchet wheel fully within said housing with said indicia being selectively positioned seriatim at a viewing position spaced substantially below said top wall; and means for causing the indicia at said viewing position to be readily discernible to the user of the vacuum cleaner notwithstanding the recessing of the indicia within the housing.

2. The vacuum cleaner nozzle structure of claim 1 wherein said means for causing the indicia at said viewing position to be readily discernible comprising viewing means extending flush with said top wall.

3. The vacuum cleaner nozzle structure of claim 1 wherein said means for causing the indicia at said viewing position to be readily discernible comprising viewing means extending flush with said top wall and spaced from said viewing position of the indicia.

4. The vacuum cleaner nozzle structure of claim 1 wherein said means for causing the indicia at said viewing position to be readily discernible comprises means for enlarging the apparent size of the indicia as seen by the user.

5. The vacuum cleaner nozzle structure of claim 1 wherein said means for causing the indicia at said viewing position to be readily discernible includes means for restricting the user's view of the indicia to substantially only the indicium disposed at said viewing position.

6. The vacuum cleaner nozzle structure of claim 1 wherein said indicia comprises words to be read by the user.

7. The vacuum cleaner nozzle structure of claim 1 wherein said indicia comprises words to be read by the user and said means for causing the indicia at said viewing position to be readily discernible comprises means for enlarging said words approximately 50%.

8. The vacuum cleaner nozzle structure of claim 1 wherein said nozzle defines a base wall and said means for rotatably mounting said ratchet wheel comprises means mounting the ratchet wheel to said base wall.

9. In a vacuum cleaner nozzle having a housing including a top wall, adjusting means for selectively adjusting the angular disposition of the nozzle housing relative to a subjacent surface to be cleaned including a ratchet wheel having indicia thereon, and user operated means for operating said adjusting means with concurrent repositioning of the ratchet wheel, the improvement comprising:

means for rotatably mounting said ratchet wheel fully within said housing with said indicia being selectively positioned seriatim at a viewing position spaced substantially below said top wall; and means on said top wall for causing the indicia at said viewing position to be readily discernible to the user of the vacuum cleaner through said top wall notwithstanding the recessing of the indicia within the housing.

10. The vacuum cleaner nozzle structure of claim 9 wherein said means for causing the indicia at said viewing position to be readily discernible includes a focus tube formed integrally with said top wall defining a viewing opening through said top wall, said tube depending from said top wall to closely adjacent said ratchet wheel and having a lower distal end confronting said ratchet wheel configured complementarily thereto.

11. The vacuum cleaner nozzle structure of claim 9 wherein said means for causing the indicia at said viewing position to be readily discernible includes a frustopyramidal focus tube formed integrally with said top wall defining a viewing opening through said top wall, said tube depending from said top wall to closely adjacent said ratchet wheel and having a lower distal end confronting said ratchet wheel configured complementarily thereto.

12. The vacuum cleaner nozzle structure of claim 9 wherein said means for causing the indicia at said viewing position to be readily discernible includes a focus tube formed integrally with said top wall defining a viewing opening through said top wall, said tube depending from said top wall to closely adjacent said ratchet wheel and having a lower distal end confronting said ratchet wheel configured complementarily thereto and a synthetic resin transparent magnifier secured in the focus tube substantially flush with said top wall.

13. The vacuum cleaner nozzle structure of claim 9 wherein said means for causing the indicia at said viewing position to be readily discernible comprises a convex-convex lens mounted substantially flush with said top wall.

14. The vacuum cleaner nozzle structure of claim 9 wherein said means for causing the indicia at said viewing position to be readily discernible includes a focus tube formed integrally with said top wall defining a viewing opening through said top wall, said tube depending from said top wall to closely adjacent said ratchet wheel and comprising a convex-convex lens mounted substantially flush with said top wall in an outer end portion of the focus tube.

15. The vacuum cleaner nozzle structure of claim 9 wherein said means for causing the indicia at said viewing position to be readily discernible includes a focus tube formed integrally with said top wall defining a viewing opening through said top wall, said tube depending from said top wall to closely adjacent said ratchet wheel and comprising a convex-convex lens mounted substantially flush with said top wall in an outer end portion of the focus tube, said lens having a plurality of depending peripheral lugs fitted into said outer end portion.

16. The vacuum cleaner nozzle structure of claim 9 wherein said means for causing the indicia at said viewing position to be readily discernible includes a frustopyramidal focus tube formed integrally with said top wall defining a viewing opening through said top wall, said tube depending from said top wall to closely adjacent said ratchet wheel and comprising a convex-convex lens mounted substantially flush with said top wall in an outer end portion of the focus tube, said lens having a plurality of depending corner lugs fitted into said outer end portion.

17. The vacuum cleaner nozzle structure of claim 9 wherein said means for causing the indicia at said viewing position to be readily discernible includes a focus tube formed integrally with said top wall defining a viewing opening through said top wall, said tube depending from said top wall to closely adjacent said ratchet wheel and comprising a convex-convex lens mounted substantially flush with said top wall in an outer end portion of the focus tube, said lens having a plurality of depending peripheral lugs fitted into said outer end portion, and having outwardly projecting shoulder portions adapted to interlock with said focus tube to lock the lens in said outer end portion thereof.

18. In a vacuum cleaner nozzle having a housing defining a top wall, the improvement comprising:

means disposed within the housing substantially below said top wall for providing an indication of an adjusted characteristic of said vacuum cleaner nozzle; and magnifying means mounted to said top wall for magnifying the indicator means to permit recognition of the indication by a user standing over the nozzle.

19. The vacuum cleaner nozzle structure of claim 18 wherein said magnifying means comprises a synthetic resin element mounted substantially flush with said top wall.

* * * * *